United States Patent [19]

Shupe et al.

[11] 4,026,219

[45] May 31, 1977

[54] KNOCK-DOWN TABLE AND FOLDABLE SUPPORTING STRUCTURE THEREFOR

[76] Inventors: Robert N. Shupe, 3217 South 3075 East, Salt Lake City, Utah 84109; David C. Haines, 107 B St. No. 406, Salt Lake City, Utah 84103

[22] Filed: Mar. 12, 1976

[21] Appl. No.: 666,204

[52] U.S. Cl. ..... 108/62; 108/13; 108/67; 108/112; 108/157

[51] Int. Cl.[2] ..... A47B 3/06

[58] Field of Search ..... 108/13, 34, 62, 67, 108/112, 90, 153, 157; 297/283

[56] References Cited

UNITED STATES PATENTS

| | | | |
|---|---|---|---|
| 983,674 | 2/1911 | Brown | 108/112 |
| 1,126,250 | 1/1915 | Möller | 108/157 |
| 2,903,312 | 9/1959 | Lawless | 108/62 |

*Primary Examiner*—James C. Mitchell
*Attorney, Agent, or Firm*—Mallinckrodt & Mallinckrodt

[57] ABSTRACT

A table for occasional or regular use that can be easily set-up from knocked down and preferably rolled up carrying condition, and vice versa, comprises a preferably roll-up table top of side-by-side slats hingedly interconnected by a flexible sheet or strip covering, and a knock-down four-legged, supporting structure for the table top. The table top, whether roll-up or otherwise, is reversible and is securable to the set-up supporting structure by snap fasteners or the like. A male member of mating snap fasteners is secured on top and preferably at one side of one end of the supporting structure and a similar member is secured on top and preferably at the opposite side and other end of the supporting structure. Female members are secured in corresponding locations on both sides of the table top.

The supporting structure preferably comprises a pair of interfitting, two-legged, mutually opposite end sections, which are similarly foldable for association with the roll-up top as a small bundle. Each section is made up of two leg members, pivotally secured to opposite ends of a table-top-receiving end member, and two table-top-receiving side members which are pivotally secured at corresponding ends to respective leg members. Foldable splice means are provided for disengageably securing together corresponding free ends of the table-top-receiving side members in interengaged relationship at opposite sides and intermediate the length of the table. Each of the pivotal securements preferably includes a spacer member of thickness equal to that of a corresponding brace member which is secured to one of the pivotally secured members and is engageable with and disengageable from the other member, whereby the brace members are accommodated in the bundle.

9 Claims, 10 Drawing Figures

FIG. 1.
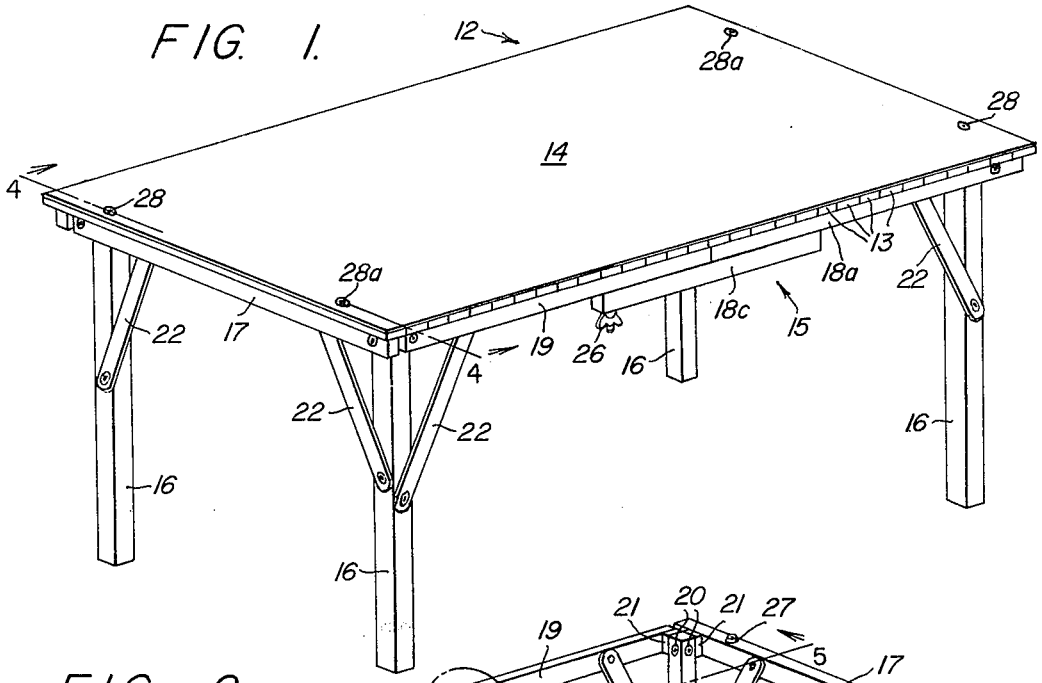
FIG. 2.
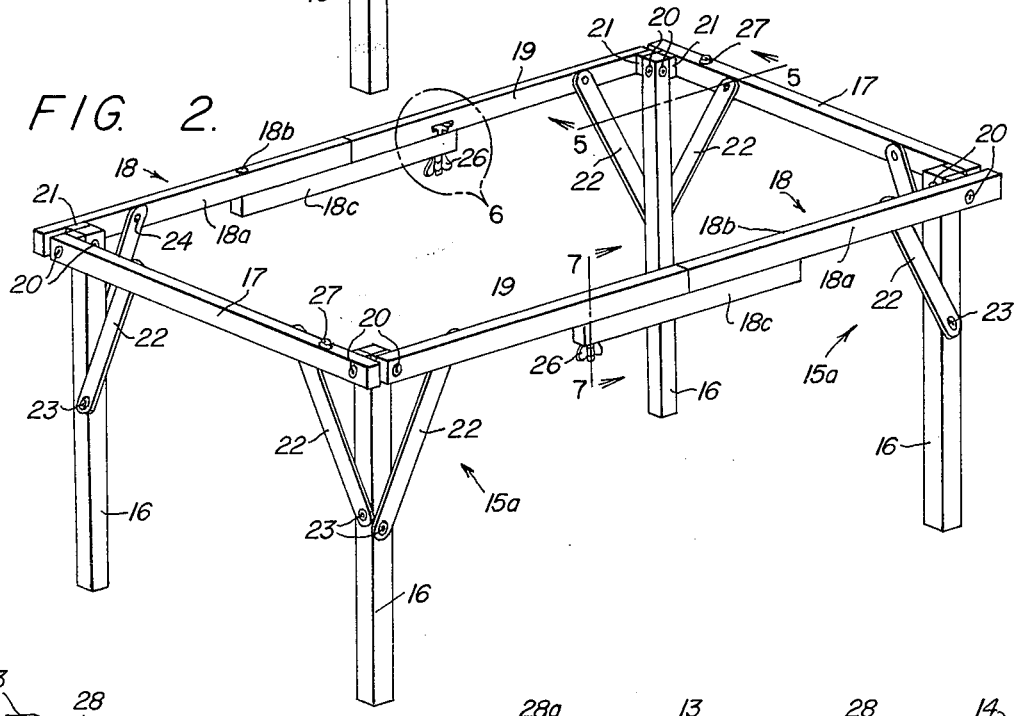
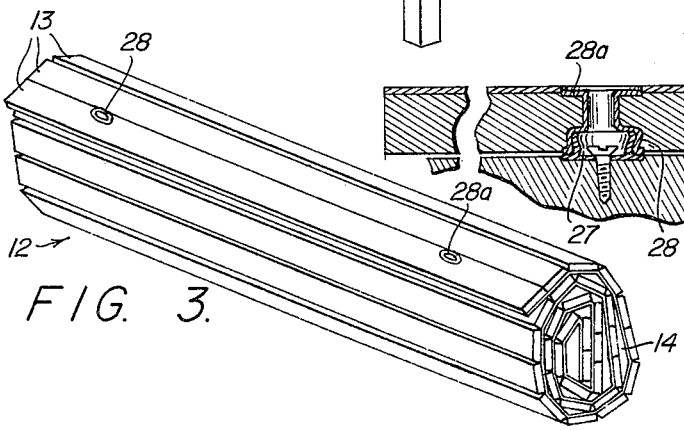
FIG. 3.
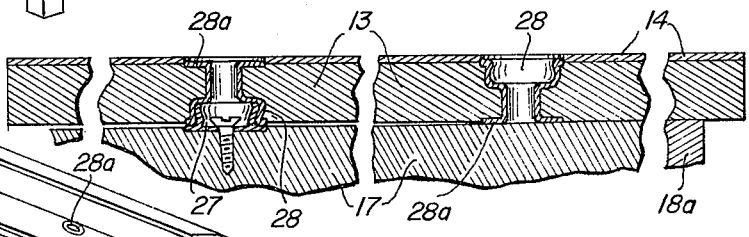
FIG. 4.

KNOCK-DOWN TABLE AND FOLDABLE SUPPORTING STRUCTURE THEREFOR

BACKGROUND OF THE INVENTION

1. Field

The invention is in the field of portable tables for a variety of special uses in which storage or carrying from place to place makes it desirable that they be capable of quick and easy disassembly, with components closely bundled together when disassembled.

2. State of the Art

Knock-down tables of the general type concerned comprising a table top of the roll-up type here preferred and knock-down supporting structure therefor, are part of the prior art by reason of our having exhibited an earlier prototype. That table was non-reversible and impractical by reason of the generally ineffective manner of attaching the table top to the supporting structure and of the cumbersome knock-down character of the supporting structure. Thus, "Velcro" was employed on the undersurface of a roll-up table top for attaching such top to the supporting structure, and separate leg and table-top-receiving members with attached braces and removable anchoring pins, were employed for the knock-down supporting structure as a collection of multiple separate pieces.

OBJECTIVES

It was an objective of the present invention to make the table top reversible and to improve its securement to the supporting structure by positive attachment means, without significant protrusion of such attachment means above the work surfaces. It was another objective to provide for slicing paired sections of the supporting structure together and for pivotal attachment of leg and table-top-receiving members so as to accommodate brace members.

SUMMARY OF THE INVENTION

In the accomplishment of the objectives of the invention, a feature is the use of snap fasteners or the like as positive attachment means for securing the table top to the supporting structure and the arrangement of such fasteners to obtain the desired positivity of securement, without undesirable protrusion of such fasteners above the surfaces of the table top. This is achieved by placing male members of mating snap fasteners at strategic locations on top of the supporting structure, and female members at corresponding locations in both faces of the reversible table top. Although the table top need not be of rectangular, roll-up type, it is preferred that it be so, and, if so, a most advantageous arrangement for the snap fasteners is at opposite sides of opposite ends of the supporting structure and table top so that a pair of opposite corners of the table top, diagonally across such top from end to end thereof, (for bracing purposes) are securely attached to the supporting structure.

In the further achievement of the objectives of the invention, leg and table-receiving members of the supporting structure are pivotally attached to fold together. It is preferred that the supporting structure be a pair of two separate but interengageable end parts with means for disengageably splicing the parts together. As such, table-top-supporting side members are provided for interengagement at opposite sides of the table as set up. One of such side members of each section is composite, having a splice part pivotally attached to and underneath a base part for receiving a correspondingly positioned side member of the other section.

In order to accommodate pivotally attached brace members when such leg and table-top-receiving members are folded, spacers of thickness corresponding to the thickness of the braces are included in the pivotal attachments.

THE DRAWINGS

A knock-down, roll-up table of rectangular configuration representing the best mode presently contemplated of carrying out the invention in practice is illustrated in the accompanying drawings, in which:

FIG. 1 is a perspective view of the table completely set up for use;

FIG. 2, a similar view in which the table top has been removed, leaving the supporting structure in completely set-up condition;

FIG. 3, a perspective view showing the removed table top rolled up for placing in a bag along with the knocked down and folded supporting structure to form a small bundle for storage or carrying from place to place;

FIG. 4, a fragmentary, transverse, vertical section taken along the line 4—4 of FIG. 1 and drawn to a larger scale, intermediate portions being broken out for convenience of illustration;

FIG. 5, a fragmentary, longitudinal, vertical section taken along the line 5—5 of FIG. 2 and drawn to the larger scale of FIG. 4;

FIG. 6, the fragmentary portion of FIG. 2 that is encircled by the line 6 in FIG. 2, drawn to the larger scale of FIGS. 4 and 5;

FIG. 7, a vertical section taken on the line 7—7 of FIG. 2 showing a detail and drawn to the larger scale of the immediately foregoing figures;

FIGS. 8, 9, and 10, progressive views in perspective of one of the table-top-supporting sections during the knock-down and folding procedures, to show how folding is accomplished.

DETAILED DESCRIPTION OF ILLUSTRATED EMBODIMENT

Figure 5:
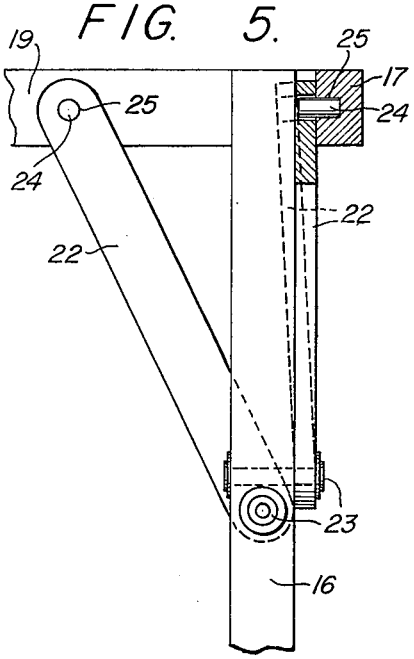
Figure 6:
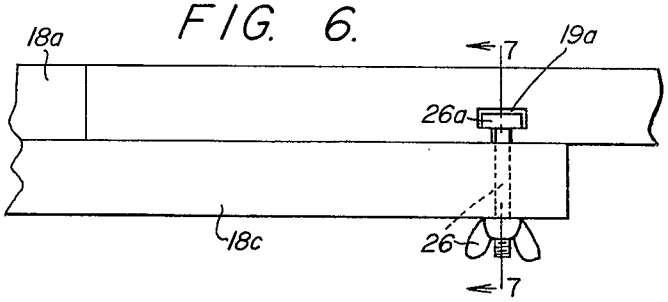

In the form illustrated, rectangular table top 12 is of roll-up type comprising side-by side slats 13 hingedly interconnected at one set of faces by a flexible, sheet covering 14 adhesively secured to the slats. As such, it can be easily rolled into compact form, as shown in FIG. 3, when detached from the top of supporting structure 15. The slats may be of wood to present an attractive wood surface at the uncovered face of table top 12. The flexible sheet covering 14 may be fabric, plastic coated for durability and attractiveness as a reverse, useable face for the table top.

Rectangular supporting structure 15 comprises a pair of interfitting, two legged, mutually opposite, end sections **15*a*, respectively, each foldable so as to fit against and along the roll-up table top of FIG. 3 and be insertable in a bag (not whown) to provide a small bundle for storage or carrying from place to place. Since corresponding members of the respective sections 15*a*** are identical, manufacture is facilitated. Such members may be easily milled to required form from standard dimension lumber.

Each of the end sections **15*a* comprises leg members 16, respectively, pivotally interconnected at their upper ends by a table-top-receiving end member 17** and having table-top-receiving side members 18 and 19, respectively, pivotally connected at corresponding ends thereof to such upper ends of the leg members. The pivotal connections 20 may be provided by standard pivot pins, and include spacers 21 interposed between the pivotally interconnected members with the pins extending therethrough. Braces 22 are pivotally attached at corresponding ends to leg members 16 as by similar pins 23, and are adapted to disengageably connect, at their opposite ends, with respective table-top-receiving members. For this purpose, such table-top-receiving members are provided with pins 24 projecting therefrom, and the connecting ends of braces 22 with pin-receiving openings 25. It should be noted that spacers 21 are commensurate in thickness with the thickness of braces 22.

For interconnecting the two table-top-supporting sections 15*a* together, the side members 18 are each of composite formation. Each comprises a base part 18*a*, to and underneath which is pivotally secured, as at 18*b*, a splicing part 18*c* that loosely carries a headed thumb screw 26. Each side member 19 is adapted to overlap the splicing part 18*c* of its corresponding side member 18 of the other section 15*a* of supporting structure 15, and is recessed re-entrantly, as at 19*a*, for receiving the head 26*a* of the corresponding thumb screw 26. Tightening of thumb screws 19 securely but disengageably fastens the interengaged, supporting structure sections 15*a* together in the set-up condition shown in FIG. 2.

For attaching table top 12 to the top of supporting structure 15 in the setting up of the table, snap fasteners are employed in a unique arrangement insuring firm securement of such table top in either one of its reversible positions, substantially without obtruding above the work surface of the table. Thus, a set of two male members 27, FIG. 2, of mating snap fasteners are secured to the top of supporting structure 15 at opposite sides of opposite ends of such structure, and mating sets of female members 28, FIGS. 1, 3, and 4, are inset at corresponding locations into opposite faces of table top 12 so as to be substantially flush with the corresponding faces. Although female snap fasteners 28 are shown as extending entirely through the slats of table top 12, so their back ends 28*a* are substantially flush with and exposed at the reverse face of such table top 12, this is merely a matter of the type of snap fastener employed for convenience of installation.

With this arrangement of snap fasteners, attachment of table top 12 is quickly, easily, and securely accomplished to place either of the reverse working faces in uppermost, working position.

Figure 8:
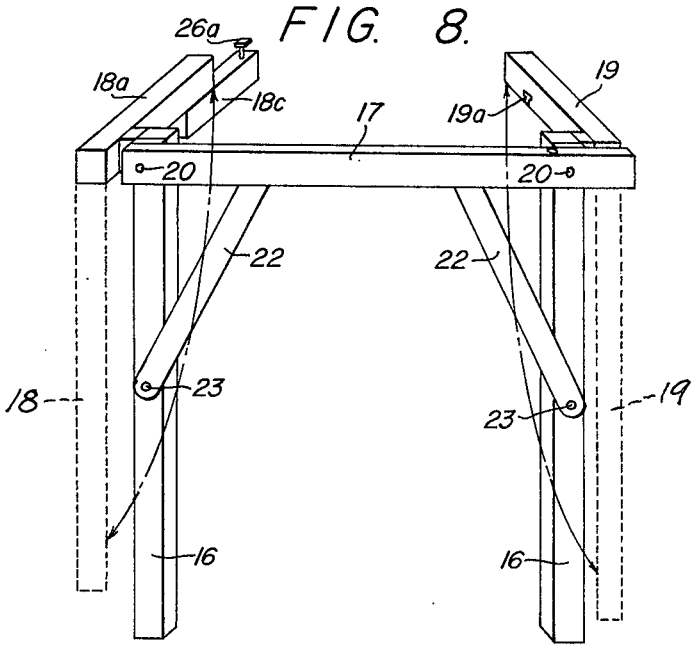
Figure 7:
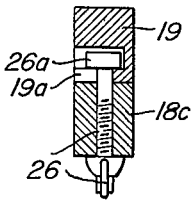
Figure 9:
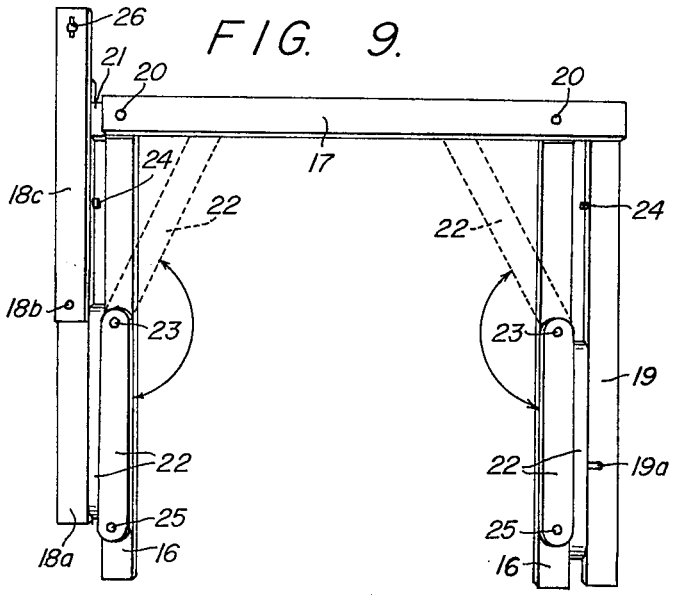
Figure 10:
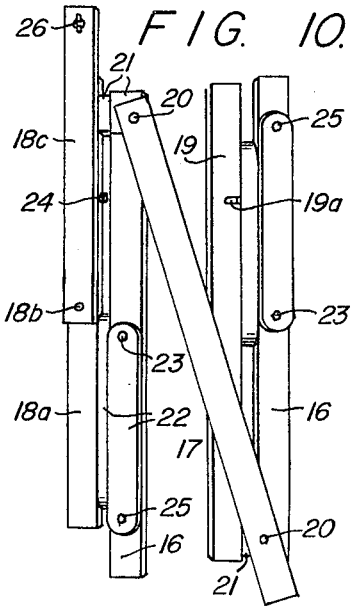

Knock-down and folding of supporting structure 15 is quickly and easily accomplished, as can be seen from FIGS. 8–10. Thus, after loosening thumb screws 26, the two sections 15*a* are separated, as in FIG. 8, and side members 18 and 19 folded down beside leg members 16, as illustrated by dotted lines. Then braces 22 are disenagaged and folded down beside leg members 16, as indicated by appended arrows in FIG. 9, the set-up positions of such braces being indicated by dotted lines. Thereafter, the leg assembly on the right in FIG. 9 is rotated counter-clockwise on its pivotal connection 20 while end member 17 is swung downwardly on its left-hand pivotal connection 20 to and through the position of FIG. 10 to completely folded condition (not shown).

Because of spacers 21, braces 22 are accommodated between folded leg, end, and side members of the table-top-supporting section 15*a*, as is indicated by FIG. 10, and the folding is effected easily and without stresses and strains on the pivotal connections and the members themselves.

It should be realized that rectangular configuration for the table is preferred but that other configurations, such as oval or even round, are possible within one or more of the several inventive concepts concerned.

Whereas this invention is here illustrated and described with respect to an embodiment thereof presently contemplated as the best mode of carrying it out in practice, various changes may be made within the broader inventive concepts pointed out in the claims that here follow, without departing from its legitimate scope.

We claim:

1. An improved, knock-down, portable table, comprising a reversible table top; supporting structure for the table top; and means for detachably fastening the table top to the supporting structure in either of its reversible positions, the fastening means being snap fasteners or the like, there being a set of two male snap fastener members secured to the top of the supporting structure and offset from one another at opposite ends thereof; sufficiently to effect diagonal bracing of the supporting structure and there being sets of correspondingly positioned, mating female snap fastener members inset into opposite faces of the table top, respectively, substantially flush with the corresponding faces.

2. An improved table in accordance with claim 1 wherein the table top and supporting structure are rectangular, and the male snap fastener members are positioned at opposite sides of opposite ends of the top of the supporting structure.

3. An improved table in accordance with claim 2, wherein the table top is of roll-up type constructed of slats positioned side-by-side and hingedly interconnected by flexible sheet material; and wherein the supporting structure comprises a pair of interfitting, two-legged, mutually opposite sections which are similarly foldable for side-by-side bundling with the table top when rolled up after being detached from the supporting structure.

4. An improved table in accordance with claim 3, wherein each section of the pair of interfitting, two legged sections of the supporting structure comprises a table-top-receiving end member; two leg members; means pivotally securing opposite ends of said end member to the respective leg members; table-top-receiving side members; means pivotally securing said side members to respective leg members; and braces pivotally secured to said leg members and adapted for attachment to respective table-top-receiving side members, one of said side members being composite for detachably receiving a correspondingly positioned side member of the other section of the supporting structure, the composite side member including a base part and a splice part, means pivotally securing the splice part to and underneath the base part, and means for detachably securing the splice part to the received side member of the said other section of the supporting structure.

5. An improved table in accordance with claim 4, wherein the means pivotally securing the splice part to the base part is a headed thumb screw loosely carried by the splice part and a re-entrant recess in the received side member of the other supporting structure section for anchoring the head of the thumb screw.

6. An improved table in accordance with claim 4, wherein spacer elements of thickness commensurate with the thickness of the braces are included in the means pivotally securing the end member to the legs and in the means pivotally securing the side members to the legs, so the braces will be accommodated in the folding of each section of the supporting structure.

7. Knock-down and foldable supporting structure for a detachable table top, comprising a pair of interfitting, two-legged, mutually opposite sections which are similarly foldable into compact form, each section of the pair comprising a table-top-receiving end member; two leg members; means pivotally securing opposite ends of said end member to the respective leg members; table-top-receiving side members; means pivotally securing said side members to respective leg members; and braces pivotally secured to said leg members and adapted for attachment to respective table-top-receiving members, one of said side members being composite for detachably receiving a correspondingly positioned side member of the other section of the supporting structure, the composite side member including a base part and a splice part, means pivotally securing the splice part to and underneath the base part, and means for detachably securing the splice part to the received side member of the said other section of the supporting structure.

8. Supporting structure for a detachable table top in accordance with claim 7, wherein the means pivotally securing the splice part to the base part is a headed thumb screw loosely carried by the splice part and a re-entrant recess in the received side member of the other supporting structure section for anchoring the head of the thumb screw.

9. Supporting structure for a detachable table top in accordance with claim 7, wherein spacer elements of thickness commensurate with the thickness of the braces are included in the means pivotally securing the end member to the legs and in the means pivotally securing the side members to the legs, so the braces will be accommodated in the folding of each section of the supporting structure.

* * * * *